US005531917A

United States Patent [19]

Nakayama et al.

[11] Patent Number: 5,531,917

[45] Date of Patent: Jul. 2, 1996

[54] METHOD FOR STABILIZING AN AGENT FOR CONTACT LENSES

[75] Inventors: Hisayuki Nakayama, Akashi; Akihiro Kimoto, Kobe; Kuniko Tsuchino, Kashiwara, all of Japan

[73] Assignee: Senju Pharmaceutical Co., Ltd., Osaka, Japan

[21] Appl. No.: 192,606

[22] Filed: Feb. 7, 1994

[30] Foreign Application Priority Data

Jul. 14, 1993 [JP] Japan ..... 5-174185
Jan. 28, 1994 [JP] Japan ..... 6-008290

[51] Int. Cl.[6] ..... C11D 3/386

[52] U.S. Cl. ..... 510/114; 134/18; 134/30; 134/42; 422/28; 435/184; 435/188; 510/393; 510/530

[58] Field of Search ..... 252/174.12, DIG. 12, 252/106; 134/18, 30, 42; 422/28; 435/184, 188

[56] References Cited

U.S. PATENT DOCUMENTS

| | | | |
|---|---|---|---|
| Re. 32,672 | 5/1988 | Huth et al. | 252/95 |
| 4,670,178 | 6/1987 | Huth et al. | 252/95 |
| 4,715,899 | 12/1987 | Chanda et al. | 134/26 |
| 4,749,511 | 6/1988 | Lad et al. | 252/174.12 |
| 5,145,643 | 9/1992 | Dziabo et al. | 422/28 |
| 5,209,703 | 5/1993 | Huth et al. | 134/19 |
| 5,218,277 | 1/1994 | Nakawaga et al. | 134/18 |
| 5,314,823 | 5/1994 | Nakagawa et al. | 435/264 |

FOREIGN PATENT DOCUMENTS

| | | |
|---|---|---|
| 0257821 | 3/1988 | European Pat. Off. . |
| 0384666 | 8/1990 | European Pat. Off. . |
| 0462460 | 12/1991 | European Pat. Off. . |
| 0482525 | 4/1992 | European Pat. Off. . |
| 0508381 | 10/1992 | European Pat. Off. . |
| 0586741 | 3/1994 | European Pat. Off. . |
| 0591956 | 4/1994 | European Pat. Off. . |
| 8604083 | 7/1986 | WIPO . |

OTHER PUBLICATIONS

Patent Abstracts of Japan vol. 016, No. 237 (P–1362), May 29, 1992 & JP–A–04 051015 (Tome Sangyo KK) Feb. 19,. 1992.

Database WPI, Section Ch, Week 8832, Derwent Publications Ltd., London, GB; Class A96, AN 88–224464 & JP–A–63 159 822 (Tome Sangyo KK) Jul. 2, 1988.

Patent Abstracts of Japan, vol. 013, No. 438 (P–939), Oct. 3, 1989 & JP–A–01 167726 (San Contact Lens:kk) Jul. 1989.

Database WPI, Section Ch, Week 8934, Derwent Publications Ltd., London, GB; class D22, AN 89–246273 & JP–A–01 180 515 (Tome Sangyo KK) Jul. 18, 1989.

*Primary Examiner*—Paul Lieberman
*Assistant Examiner*—Kery Fries
*Attorney, Agent, or Firm*—Wenderoth, Lind & Ponack

[57] ABSTRACT

A method for stabilizing an agent for contact lenses containing a proteolytic enzyme by adding a surfactant to a solution containing an effective amount of a proteolytic enzyme, the production of a lyophilized agent for contact lenses containing a proteolytic enzyme, which comprises subjecting an aqueous composition containing a proteolytic enzyme to a lyophilizing treatment in the presence of a surfactant, and a lyophilized agent for contact lenses which contains a proteolytic enzyme and a surfactant. The method of the present invention enables stable preservation of a proteolytic enzyme in a liquid form. In addition, cleaning, sterilization and preservation can be simultaneously performed with a single solution, wherein an efficient removal of soil is achieved by only immersing contact lenses in the agent in a solution state. Accordingly, the agent of the present invention is advantageously used with ease by simple handling. The method for producing the lyophilized agent of the present invention enables stabilization of a proteolytic enzyme during preparation into a lyophilized formulation. Furthermore, the lyophilized agent of the present invention permits the proteolytic enzyme to remain stable and is extremely superior in solubility. When preserved as an aqueous solution, the stability of the enzyme can be maintained over a long period of time due to the action of a surfactant contained therein.

4 Claims, No Drawings

METHOD FOR STABILIZING AN AGENT FOR CONTACT LENSES

FIELD OF THE INVENTION

The present invention relates to a method for stabilizing an agent for contact lenses containing a proteolytic enzyme, which comprises adding a surfactant to the agent. The present invention also relates to a method for producing a lyophilized agent for contact lenses containing a proteolytic enzyme. Further, the present invention relates to a lyophilized agent for contact lenses containing a proteolytic enzyme.

BACKGROUND OF THE INVENTION

Contact lenses are classified into hard contact lenses and soft contact lenses. While hard contact lenses were non-hydrophilic and less oxygen-permeable, those having improved oxygen permeability have been developed in recent years. These lenses are susceptible to soil by protein etc. and need to be cleaned, sterilized and preserved daily as with soft contact lenses for an additional effect of maintaining oxygen permeability.

A protein soil attached to the surface of contact lenses can be decomposed and removed by the action of a proteolytic enzyme and various cleaning agents have been proposed and actually used. The proteolytic enzyme is, however, unstable in water and various measures have been employed to overcome this defect. For example, an agent in the form of a solid containing a proteolytic enzyme as a main component, such as tablet, granule, powder or the like is provided and an end-user dissolves same in purified water etc. every time before actual use. This method of dissolving a solid cleaning agent every time of use causes high prices, as well as forces users to undergo troublesome procedure. In addition, said preparation in a solid state tends to suffer from poor solubility. Meanwhile, there have been proposed several methods for stabilizing a proteolytic enzyme in a solution state to provide a treating solution for contact lenses. For example, Japanese Patent Unexamined Publication No. 167726/1989 discloses a preserving solution containing a water soluble polymer having quaternary ammonium group and hydroxyl group, and an enzyme. This preserving solution shows poor cleaning effect and is insufficient as a cleaning solution. Also, Japanese Patent Unexamined Publication Nos. 159822/1988 and 180515/1989 propose a method for stabilizing a proteolytic enzyme by adding the enzyme to a solution containing a water miscible organic liquid. However, the enzyme activity of this solution is extremely low such that its cleaning effect is unpractical. Some of the conventional enzyme-stabilized solutions for contact lenses require diluting for use so as to achieve high enzyme activity. This method has a defect in that the proteolytic enzyme activity is scarce when the concentration of an organic liquid is high and that although the activity can be enhanced upon dilution with water, the stability is degraded.

The present invention has been made in view of the aforementioned situations and aims at stabilizing a proteolytic enzyme in a solution (particularly aqueous solution) and ultimately providing an agent for contact lenses which enables simultaneous cleaning, sterilization and preservation of contact lenses with a single solution.

Another object of the present invention is to stabilize, in producing a lyophilized agent for contact lenses containing a proteolytic enzyme, the proteolytic enzyme during lyophilization of the agent.

A still another object of the present invention is to provide an agent for contact lenses containing a proteolytic enzyme, which permits the proteolytic enzyme to remain stable.

The present inventors took note of the stabilization of proteolytic enzymes capable of removing a protein soil and conducted intensive studies to find that a small amount of a surfactant can achieve stabilization of a proteolytic enzyme in a solution, particularly in an aqueous solution.

As mentioned above, proteolytic enzymes are known to be inactivated in the presence of water. Many surfactants contain water, for which reason a proteolytic enzyme is speculated to be inactivated by the water contained in a surfactant when the two are co-existent, according to the technical level of the field. In light thereof, the aforesaid finding was totally unpredictable.

In addition, the present inventors have found that lyophilization of an agent for contact lenses which contains a proteolytic enzyme results in sufficient removal of water, which in turn affords ensured stabilization of a proteolytic enzyme, and that said lyophilized product is superior in solubility when in use.

In preparing a lyophilized preparation, however, a proteolytic enzyme can be inactivated even when a liquid composition containing a proteolytic enzyme to be subjected to the lyophilization treatment is being prepared, thus making preparation of a lyophilized agent very difficult. To be specific, an aqueous solution containing a proteolytic enzyme which is usually charged in a vial etc. is subjected to a lyophilization treatment to afford a lyophilized preparation. During said procedure, charging of an aqueous solution containing a proteolytic enzyme in a vial etc. and freezing thereof take quite a long time to the point that the proteolytic enzyme is inactivated.

Surprisingly, the present inventors have now found that inactivation of a proteolytic enzyme during the preparation of a lyophilized preparation can be markedly inhibited by the presence of a surfactant.

SUMMARY OF THE INVENTION

That is, the present invention relates to a method for stabilizing an agent for contact lenses containing a proteolytic enzyme, which comprises adding a surfactant, particularly at least one member selected from the group consisting of anionic surfactants, amphoteric surfactants and nonionic surfactants, to a solution containing an effective amount of a proteolytic enzyme, which ultimately enables cleaning, sterilization and preservation of contact lenses with a single solution.

Also, the present invention relates to the production of a lyophilized agent for contact lenses containing a proteolytic enzyme, which comprises subjecting an aqueous composition containing a proteolytic enzyme to a lyophilizing treatment in the presence of a surfactant.

Furthermore, the present invention relates to a lyophilized agent for contact lenses which contains a proteolytic enzyme and a surfactant.

DETAILED DESCRIPTION OF THE INVENTION

Examples of the surfactant to be used in the present invention include nonionic surfactants, anionic surfactants and amphoteric surfactants. These surfactants can be effectively used in an appropriate combination. These surfactants are known to generally show an antimicrobial action along with a cleaning action.

Examples of the anionic surfactant include sodium lauroyl sarcosinate, lauroyl-L-glutamic triethanolamine and sodium myristyl sarcosinate; examples of amphoteric surfactant include lauryl dimethylaminoacetic betaine, 2-alkyl-N-carboxymethyl-N-hydroxyethylimidazolinium betaine and hydrochloric alkyldiaminoglycine; and examples of nonionic surfactants include Polysorbate 80, Polyoxyethylene castor oil 60, Polyoxyl stearate 40 and polyoxyethylene lauryl ether. Exemplary combinations of the surfactants are lauroyl-L-glutamic triethanolamine (anionic surfactant) and Polysorbate 80 (nonionic surfactant); and lauroyl-L-glutamic triethanolamine (anionic surfactant) and lauryl dimethylaminoacetic betaine (amphoteric surfactant).

The surfactants are contained at such a concentration as permits sufficient enzyme stability without harmful influences on contact lenses, which is preferably about 0.01–10 (w/v) %, more preferably about 0.1–3 (w/v) %.

The proteolytic enzyme to be used in the present invention is exemplified by papain derived from plant, trypsin and chymotrypsin derived from animal, and protease derived from the genus Bacillus, and is selected as appropriate. The most preferred in terms of enzyme stability in a liquid is a proteolytic enzyme derived from a microorganism belonging to the genus Bacillus, such as Bioprase (trademark, manufactured by Nagase Seikagaku Kogyo K.K., Japan). In the present invention, the amount of the proteolytic enzyme to be used is suitably calculated on the basis of the effective amount affording a desired cleaning effect, which is preferably about 10–5000 units/ml, more preferably about 50–1000 units/ml. Too small an amount results in insufficient cleaning effect and too high an amount thereof is liable to cause skin disorders when cleaning lenses.

The pH of the agent for contact lenses which is stabilized by the method of the present invention is preferably from 4 through 8 in view of the stabilization of proteolytic enzyme.

In the present invention, the form of the agent for contact lenses is subject to no particular limitation so long as it can be prepared into a liquid composition when in use and exemplified by liquid preparations and solid formulations which are stored for a long time and dissolved when in use. Examples of the solid formulation include tablets, granules, powders and lyophilized products. When seen from the aspects of fast dissolution, sterilization and uniformity of the composition, a lyophilized product is preferable. Note that the above-mentioned amounts of surfactant and proteolytic enzyme and pH are: when the agent for contact lenses is a solid formulation, those when they are prepared into a liquid agent for contact lenses; and in the production of a lyophilized agent for contact lenses containing a proteolytic enzyme, those in an aqueous composition containing a proteolytic enzyme, which is to be lyophilized.

With respect to the present invention, the agent for contact lenses may contain, insofar as its stability is not impaired, various additives such as conventionally-employed preservative (e.g. benzalkonium chloride, chlorohexyzine gluconate, parabenes, alkyldiaminoethylglycine hydrochloride, chlorobutanol, sorbic acid), pH adjusting agent (e.g. hydrochloric acid, phosphoric acid, sulfuric acid, sodium hydroxide, ammonia), buffer (e.g. borate, citrate, phosphate, triethanolamine), chelating agent, excipients such as disintegrator and binder, and other enzymes such as lipase.

The use of the agent for contact lenses which is stabilized by the method of the present invention generally comprises placing a contact lens detached from the eye in a liquid agent (for example, the agent for contact lenses of the invention in a solution state) and immersing same for 1 to 12 hours. By the immersion, cleaning is performed as sterilization proceeds by the antimicrobial action possessed by surfactants. Addition of a preservative ensures exertion of the antimicrobial action. After the immersion, the contact lens is rinsed with tap water etc. and worn again. It has been confirmed that a consecutive 1 week use of the same solution does not pose any problems.

In the present invention, an agent for contact lenses is preferably that for hard contact lenses.

Incidentally, proteolytic enzyme is inactivated even when preparing an aqueous composition containing a proteolytic enzyme to be subjected to a lyophilization treatment. So as to avoid the inactivation, lyophilized preparations are produced in the presence of a surfactant in the present invention. A lyophilized preparation is produced, for example, as in the following.

A proteolytic enzyme and a surfactant are dissolved or dispersed in water, preferably purified water. In doing so, it is preferable that stirring for dissolution or dispersion be conducted at a low speed so as to inhibit foaming caused by the surfactant.

Freezing is generally performed at −10° C. to −40° C. Drying after freezing is carried out at not more than 40° C. The drying is preferably performed with increasing temperature.

By performing the drying after freezing at a temperature not more than 40° C., a product superior in solubility in use can be obtained.

A lyophilized agent for contact lenses is stored stably before use in a lyophilized state and is dissolved in water (preferably purified water or distilled water for injection) for actual use. The concentrations of proteolytic enzyme and surfactant, and pH of the liquid composition preferably fall within the aforementioned ranges. Accordingly, it is preferable that a predetermined amount of a lyophilized agent for contact lenses and a predetermined amount of water to dissolve same should be set in one kit. It is needless to say that the stability of the agent dissolved in water for use is improved due to the presence of a surfactant.

The present invention is hereinbelow described in detail by illustration of Examples. However, they are not to be construed as limitative.

EXAMPLE 1

Each component shown in Table 1 was dissolved in purified water to give various samples. Each of the samples obtained was measured for the amount of enzyme immediately after the preparation and after preservation at 30° C. for 7 days. The residual activity (%) was calculated by the following formula. The results are shown in Table 1.

$$\text{Residual enzyme activity (\%)} = \frac{\text{Enzyme activity upon preservation at 30° C. for 7 days}}{\text{Enzyme activity immediately after preparation of sample}} \times 100$$

TABLE 1

| Sample No. | Control | 1 | 2 | 3 | 4 | 5 | 6 | 7 | 8 | 9 | 10 | 11 | 12 |
|---|---|---|---|---|---|---|---|---|---|---|---|---|---|
| Bioprase (unit/ml) | 240 | 240 | 240 | 240 | 240 | 240 | 240 | 240 | 240 | 240 | 240 | 240 | 240 |
| A Sodium lauroyl sarcosinate | | 0.5% | | | | | | 0.5% | 0.5% | | | | 0.5% |
| Lauroyl-L-glutamic | | | 0.5% | | | | | | | | 0.5% | 0.5% | 0.5% |
| B Lauryl dimethylamino-acetic betaine | | | | 0.5% | | | | 0.5% | | 0.5% | 0.5% | | |
| C Polysorbate 80 | | | | | 0.5% | | | | 0.5% | 0.5% | | 0.5% | 0.5% |
| Polyoxyethylene castor oil 60 | | | | | | 0.5% | | | | | | | |
| Polyoxyl stearate 40 | | | | | | | 0.5% | | | | | | |
| Disodium hydrogenphosphate | 0.2% | 0.2% | 0.2% | 0.2% | 0.2% | 0.2% | 0.2% | 0.2% | 0.2% | 0.2% | 0.2% | 0.2% | 0.2% |
| Phosphoric acid | s.a. | s.a. | s.a. | s.a. | s.a. | s.a. | s.a. | s.a. | s.a. | s.a. | s.a. | s.a. | s.a |
| Sodium hydroxide | s.a. | s.a. | s.a. | s.a. | s.a. | s.a. | s.a. | s.a. | s.a. | s.a. | s.a. | s.a. | s.a |
| Sodium chloride | 0.9% | 0.9% | 0.9% | 0.9% | 0.9% | 0.9% | 0.9% | 0.9% | 0.9% | 0.9% | 0.9% | 0.9% | 0.9% |
| Purified water | s.a. | s.a. | s.a. | s.a. | s.a. | s.a. | s.a. | s.a. | s.a. | s.a. | s.a. | s.a. | s.a |
| pH | 7.0 | 7.0 | 7.0 | 7.0 | 7.0 | 7.0 | 7.0 | 7.0 | 7.0 | 7.0 | 7.0 | 7.0 | 7.0 |
| Residual enzyme activity (%) 30° C., 7 days | 54.4 | 86.0 | 88.6 | 87.4 | 87.9 | 85.6 | 87.3 | 88.0 | 90.0 | 88.1 | 94.8 | 95.5 | 85.6 |

Note:
A — anionic surfactant,
B — amphoteric surfactant,
C — nonionic surfactant,
s.a. = suitable amount As is evident from Table 1, addition of a surfactant to a solution containing a proteolytic enzyme results in remarkably improved stabilization of the proteolytic enzyme. A hard contact lens was immersed in each of the samples (sample Nos. 1–12) for 7 days. As a result, no substantial development of bacteria was observed and wettability of the hard contact lens was maintained.

EXAMPLE 2

| | |
|---|---|
| Bioprase | 1200 units |
| Sodium lauroyl salcosinate | 0.03 g |
| Lauryl dimethylaminoacetic betaine (35%) | 0.05 g |
| Lauroyl-L-glutamic triethanolamine (30%) | 0.1 g |
| Boric acid | 0.03 g |
| Sodium borate | 0.018 g |
| Sodium edetate | 6 mg |
| Chlorohexydine gluconate | 0.3 mg |
| Sodium thiosulfate | 0.015 mg |

Purified water (6 ml) was added to a lyophilized preparation of the above composition and the mixture was left standing for 5 seconds. As a result, the preparation was dissolved satisfactorily to give a colorless, clear liquid composition. The obtained sample was left standing at room temperature for 7 days and residual enzyme activity was measured as in Example 1. As a result, it was found that the residual activity was 93.9% and the liquid composition showed fine cleaning effect against soil of lipid and protein. In addition, no substantial development of bacteria was observed.

EXAMPLE 3

| | |
|---|---|
| Bioprase | 1200 units |
| Sodium lauroyl salcosinate | 0.03 g |
| Lauryl dimethylaminoacetic betaine (35%) | 0.05 g |
| Lauroyl-L-glutamic triethanolamine (30%) | 0.1 g |
| Boric acid | 0.03 g |

-continued

| | |
|---|---|
| Sodium borate | 0.018 g |
| Sodium edetate | 6 mg |
| Methyl p-hydroxybenzoate | 6 mg |
| Sodium thiosulfate | 0.015 mg |

In the same manner as in Example 2, a liquid composition was prepared and subjected to the same test as in Example 2. As a result, the residual activity was 95.1% and the liquid composition showed fine cleaning effect against soil of lipid and protein. In addition, no substantial development of bacteria was observed.

EXAMPLE 4

| | |
|---|---|
| Bioprase | 1000 units |
| Polyoxyl 40 stearate | 0.03 g |
| Lauroyl-L-glutamic triethanolamine (30%) | 0.1 g |
| Hydrochloric alkyldiaminoglycine | 0.6 mg |
| Boric acid | 0.03 g |
| Sodium borate | 3 g |
| Sodium edetate | 0.6 mg |

The above composition was dissolved in 6 ml of purified water to give an agent for contact lenses containing a proteolytic enzyme. The obtained sample was subjected to the same test as in Example 2 and a superior result was obtained.

The method for stabilizing an agent for contact lenses containing a proteolytic enzyme of the present invention enables stable preservation, in a liquid form, of a proteolytic enzyme to be used for an agent for contact lenses containing a proteolytic enzyme. In addition, cleaning, sterilization and preservation can be simultaneously performed with a single solution of an agent for contact lenses containing a proteolytic enzyme. The agent of the present invention enables efficient removal of soil by only immersing contact lenses in the agent in a liquid form. Accordingly, the agent of the present invention can be advantageously used with ease by simple handling. The method for producing a lyophilized agent for contact lenses containing a proteolytic enzyme of the present invention enables stabilization of a proteolytic enzyme during preparation procedure into a lyophilized formulation, thus providing an agent for contact lenses containing a proteolytic enzyme which is superior in proteolytic enzyme activity. Furthermore, a lyophilized agent for contact lenses containing a proteolytic enzyme of the present invention permits the proteolytic enzyme to remain stable and is extremely superior in solubility. When preserved as an aqueous solution, the stability of the proteolytic enzyme can be maintained over a long period of time due to the action of a surfactant contained therein.

What is claimed is:

1. A method for producing a stable lyophilized enzyme composition for cleaning contact lenses, which comprises the steps of:

preparing an aqueous mixture comprising a proteolytic enzyme in a concentration of 10–5,000 units/ml and an enzyme stabilizing surfactant in an amount of 0.01–10% weight per volume which stabilizes the enzyme, wherein the enzyme stabilizing surfactant is at least one selected from the group consisting of anionic surfactants, amphoteric surfactants and nonionic surfactants, and lyophilizing the aqueous mixture to obtain a stable lyophilized enzyme composition.

2. The method according to claim 1, wherein the surfactant is at least one selected from the group consisting of sodium lauroyl sarcosinate, lauroyl-L-glutamic triethanolamine, sodium myristyl sarcosinate, lauryl dimethylaminoacetic betaine, 2-alkyl-N-carboxymethyl-N-hydroxyethylimidazolinium betaine, hydrochloric alkyldiaminoglycine, Polysorbate 80, Polyoxyethylene castor oil 60, Polyoxyl stearate 40, and polyoxyethylene lauryl ether.

3. The method of claim 1, wherein the aqueous composition is frozen at a temperature of from –40° C. to –10° C.

4. The method of claim 1, wherein the aqueous composition is dried after freezing at a temperature not more than 40° C.

* * * * *